US005259519A

United States Patent [19]

Lieberman

[11] Patent Number: 5,259,519

[45] Date of Patent: Nov. 9, 1993

[54] ADVERTISER AND HYGIENIC DISPOSABLE TOOTHBRUSH HOLDER

[76] Inventor: William B. Lieberman, 3611 3rd Ave., Beaver Falls, Pa. 15010

[21] Appl. No.: 2,945

[22] Filed: Jan. 11, 1993

[51] Int. Cl.[5] ..... A47F 7/00

[52] U.S. Cl. ..... 211/66; 211/94; 248/110; 248/205.3

[58] Field of Search ..... 211/65, 66, 94; 248/205.3, 110, 225.1

[56] References Cited

U.S. PATENT DOCUMENTS

| | | | |
|---|---|---|---|
| 1,972,532 | 9/1934 | McMillan | 211/65 X |
| 2,916,155 | 12/1959 | Elliott | 211/66 X |
| 3,002,630 | 10/1961 | Heisser | 211/65 |
| 3,138,414 | 6/1964 | La Pollo | 211/65 X |
| 3,685,660 | 8/1972 | Saunders | 211/65 X |
| 3,794,181 | 2/1974 | Canham | 248/205.3 X |
| 4,566,597 | 1/1986 | Caputo et al. | 248/110 X |
| 4,854,457 | 8/1989 | Perler | 211/65 |

FOREIGN PATENT DOCUMENTS

| | | | |
|---|---|---|---|
| 700570 | 12/1940 | Fed. Rep. of Germany | 211/65 |
| 2739595 | 3/1979 | Fed. Rep. of Germany | 248/110 |
| 280037 | 4/1952 | Switzerland | 211/65 |

*Primary Examiner*—Robert W. Gibson, Jr.
*Attorney, Agent, or Firm*—William J. Ruano

[57] ABSTRACT

A removable toothbrush holder having a rear, T-shaped projection which fits into a permanent holder of somewhat C-shape for slidably supporting the projection. The holder has holes for receiving and holding toothbrushes. A vertically extending integral splash wall is formed on the holder to protect the permanent holder from contamination by toothbrushes. It also serves as a base for advertisements or instructions to guests.

3 Claims, 1 Drawing Sheet

ADVERTISER AND HYGIENIC DISPOSABLE TOOTHBRUSH HOLDER

BACKGROUND OF THE INVENTION

A source of mouth disease and systemic infection spread is the lack of a toothbrush holder in hotels and hospitals. While disposable toothbrush holders have been used in the past, they have not solved the problem of accidental tipping of the toothbrush onto the support for the toothbrush holder. Furthermore, a unique place for advertising or instructions to hotel guests can be on the toothbrush holder since it is sure to be seem by guests.

SUMMARY OF THE INVENTION

The invention comprises a disposable toothbrush holder wherein its permanent support includes a barrier to protect the permanent support from contact by toothbrushes and at the same time the barrier serving as a base for instructions or advertising.

DESCRIPTION OF THE PREFERRED EMBODIMENT

Figure 1:
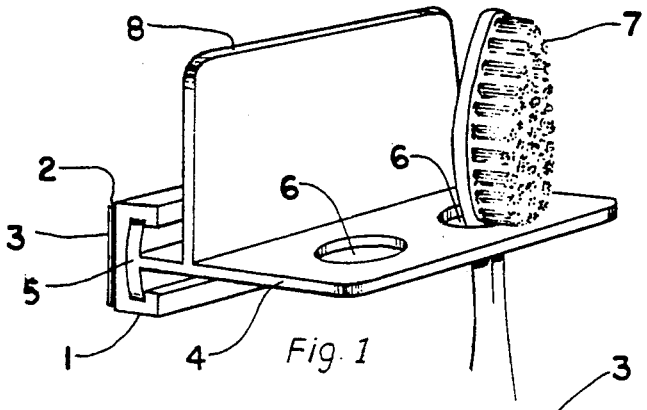
FIG. 1 is a top perspective view of a combined advertiser and disposable toothbrush holder and part of its base of the present invention together with a fragmentary view of a toothbrush.
Figure 2:
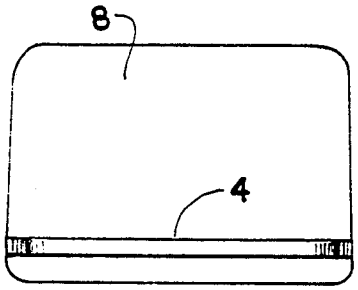
FIG. 2 is a front view.
Figure 3:
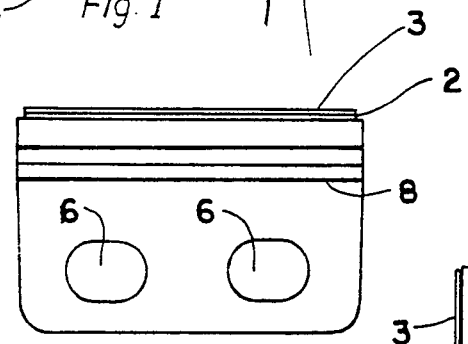
FIG. 3, a top view
Figure 4:
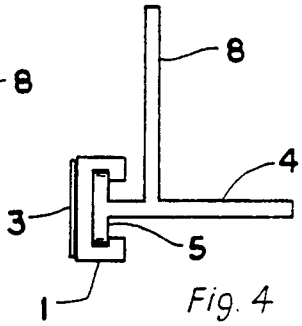
FIG. 4 is a side view of both base and holder.
Figure 5:
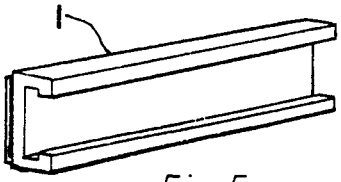
FIG. 5 is a top perspective view of the base or holder thereof, the back of which is glued to a wall by double faced tape on the rear thereof.

Referring to FIGS. 1-6 of the drawing, FIG. 5 denotes a permanent holder or base of somewhat C-shaped cross-section having a double faced adhesive backing 2 having a non-adhesive cover tear sheet 3, used for packaging. When the tear sheet 3 is removed, the adhesive on the backing 2 is used to adhere the holder 1 to a bathroom wall mirror or tile. Of course, screws or the like may be used instead for this purpose.

Figure 6:
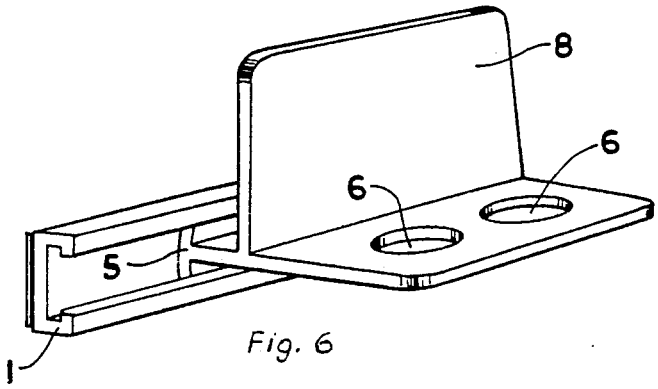
FIG. 6 is a top perspective view of the combined advertiser and disposable toothbrush holder, in a partially moved position for its removal from the base holder.

The toothbrush holder FIG. 4 has a rear T-shaped end portion 5 which is longitudinally slidable in the holder 1 as shown in FIG. 6. The holder has holes 6 for supporting toothbrushes such as 7.

An integral splash plate 8 of about the same or greater height than the bristles of the toothbrush 7, is integrally formed on holder 4 to prevent splashing of possibly contaminated liquid from the bristles of the toothbrush onto the permanent holder 1. The splash plate 8 may also be used for advertising or for instructions to guests.

After a guest departs from the hotel, or patient from a hospital the toothbrush holder 4 is removed from the permanent holder 1, discarded and replaced by a new prepackaged holder.

I claim:

1. A removable toothbrush holder having a horizontal portion and an intermediate, integral, vertically upwardly extending splash wall, the front part of said horizontal portion having at least one hole for receiving the handle of a toothbrush whereby said front part will support one end of the bristles of said toothbrush, the rear part of said horizontal portion having an integral vertically extending end portion which extends above and below the end of said horizontal portion, a holder of somewhat C-shaped cross-section for snugly and slidably supporting said end portion, and means for fastening said holder to a vertical wall, whereby said toothbrush end portion can be slidably removed from said holder and whereby said splash wall will protect said holder from contamination by said toothbrush and will serve as a base for advertising.

2. A removable toothbrush holder as recited in claim 1 together with a second hole in said front part of said horizontal portion.

3. A removable toothbrush holder as recited in claim 1 wherein said holder has a double faced adhesive backing covered by a protective sheet for packaging purposes.

* * * * *